US006901999B2

(12) United States Patent
Sugden

(10) Patent No.: US 6,901,999 B2
(45) Date of Patent: Jun. 7, 2005

(54) SWABBING TOOL FOR WELLS

(75) Inventor: Daryl R. Sugden, Innisfail (CA)

(73) Assignee: Nabors Industries, Inc., Houston, TX (US)

( * ) Notice: Subject to any disclaimer, the term of this patent is extended or adjusted under 35 U.S.C. 154(b) by 0 days.

(21) Appl. No.: 10/688,149

(22) Filed: Oct. 17, 2003

(65) Prior Publication Data

US 2004/0089446 A1 May 13, 2004

(30) Foreign Application Priority Data

Nov. 8, 2002 (CA) ..... 2411618

(51) Int. Cl.[7] ..... E21B 37/10

(52) U.S. Cl. ..... 166/105.1; 166/105.2; 166/177.3

(58) Field of Search ..... 166/177.3, 227, 166/105.1, 105.2, 105.3, 105.4; 417/555.2

(56) References Cited

U.S. PATENT DOCUMENTS 5,119,874 A * 6/1992 Ferguson et al. ..... 166/105.2
5,553,669 A * 9/1996 Trainer ..... 166/105.1
6,145,590 A * 11/2000 Havard ..... 166/105.2
6,619,390 B1 * 9/2003 Kellett, III ..... 166/105.1

OTHER PUBLICATIONS

H. Bogart; B. Jacobs; K. MacPhail, M. Malone, G. Sonnleitner; "Testing of Wire Rope Sockets"; Engineering Science Laboratories, Montana Tech, May 2, 1984.
Bruce Levan; "Preliminary Analysis of a Sand Line"; Canspec Group Inc, Jul. 6, 1999.
David R. Hall; "Electromagnetic Inspection of Wire Ropes Vertical Lift Bridges", Jun. 2002.

* cited by examiner

*Primary Examiner*—David Bagnell
*Assistant Examiner*—Elton McWilliams
(74) *Attorney, Agent, or Firm*—Baker Botts L.L.P.

(57) ABSTRACT

A swabbing tool for wells that filters particulates from fluids passing through the swabbing tool. The swabbing tool comprises a mandrel, at least one swab cup on the mandrel, the mandrel and swab cup being arranged to allow fluids to pass from below to above the swab cup; and a sifter attached to the swabbing tool below the swab cup for filtering particulates from fluid passing from below to above the swab cup. The sifter is barrel shaped and is provided with a sealing element attached to the sifter to force fluid into the sifter. The sifter has an interior and the sealing element is dimensioned to seal against a casing or tubing wall and force fluid into the sifter. The openings in the sand sifting element may be slots, with a size between 0.125 mm to 0.635 mm.

9 Claims, 2 Drawing Sheets

SWABBING TOOL FOR WELLS

BACKGROUND OF THE INVENTION

This invention relates to equipment and methods used for the swabbing of wells, particularly oil and gas wells.

Swabbing is used to obtain production from an underground formation that has a pressure insufficient to overcome downhole hydrostatic pressure. A swabbing tool is lowered into a well on a wire line to near a producing formation. The swabbing tool typically has a mandrel and swab cups extending out from the mandrel. Passageways between the mandrel and swab cups allow fluid to bypass the swab cups when the swabbing tool is lowered in the well. As the swabbing tool is lowered into the well, fluid in the wellbore below the swabbing tool bypasses the swab cups into the wellbore above the swabbing tool. When a desired level of the swabbing tool is reached, the tool is pulled up and the swab cups slide down the mandrel onto a sealing plate that seals the passageways. Pulling up on the swabbing tool lifts the fluid above the swab cups and generates a strong suction force in the tubing below the swab cups. The suction tends to draw fluid from the producing formation. However, it often occurs that the wellbore fluid has entrained particulate matter introduced naturally or from production activities. This particulate matter, often including sand, can bypass the swab cups and settle onto the swab cups. With sufficient volume of sand, the swab cups and the swabbing tool can become stuck in the well. The present invention is intended to overcome this problem.

SUMMARY OF THE INVENTION

Therefore there is provided a swabbing tool for wells that filters particulates from fluids passing through the swabbing tool. According to an aspect of the invention, the swabbing tool comprises a mandrel, at least one swab cup on the mandrel, the mandrel and swab cup being arranged to allow fluids to pass from below to above the swab cup; and a sifter attached to the swabbing tool below the swab cup for filtering particulates from fluid passing from below to above the swab cup. The sifter is preferably barrel shaped and is provided with a sealing element attached to the sifter to force fluid into the sifter. According to a further aspect of the invention, the sifter has an interior and the sealing element is dimensioned to seal against a casing or tubing wall and force fluid into the sifter. The openings in the sand sifting element may be slots, with a size between 0.125 mm to 0.635 mm.

These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration only and not with the intention of limiting the scope of the invention, in which like numerals denote like elements and in which.

DETAILED DESCRIPTION OF PREFERRED EMBODIMENTS

In this patent document, "comprising" means "including". In addition, a reference to an element by the indefinite article "a" does not exclude the possibility that more than one of the element is present. The tool of the present invention is intended for use in a wellbore. The term axial refers to the direction along the wellbore, while the term lateral is indicative of a direction perpendicular to the axial direction and the term radial means outward from a central axis of the wellbore.

Figure 1:
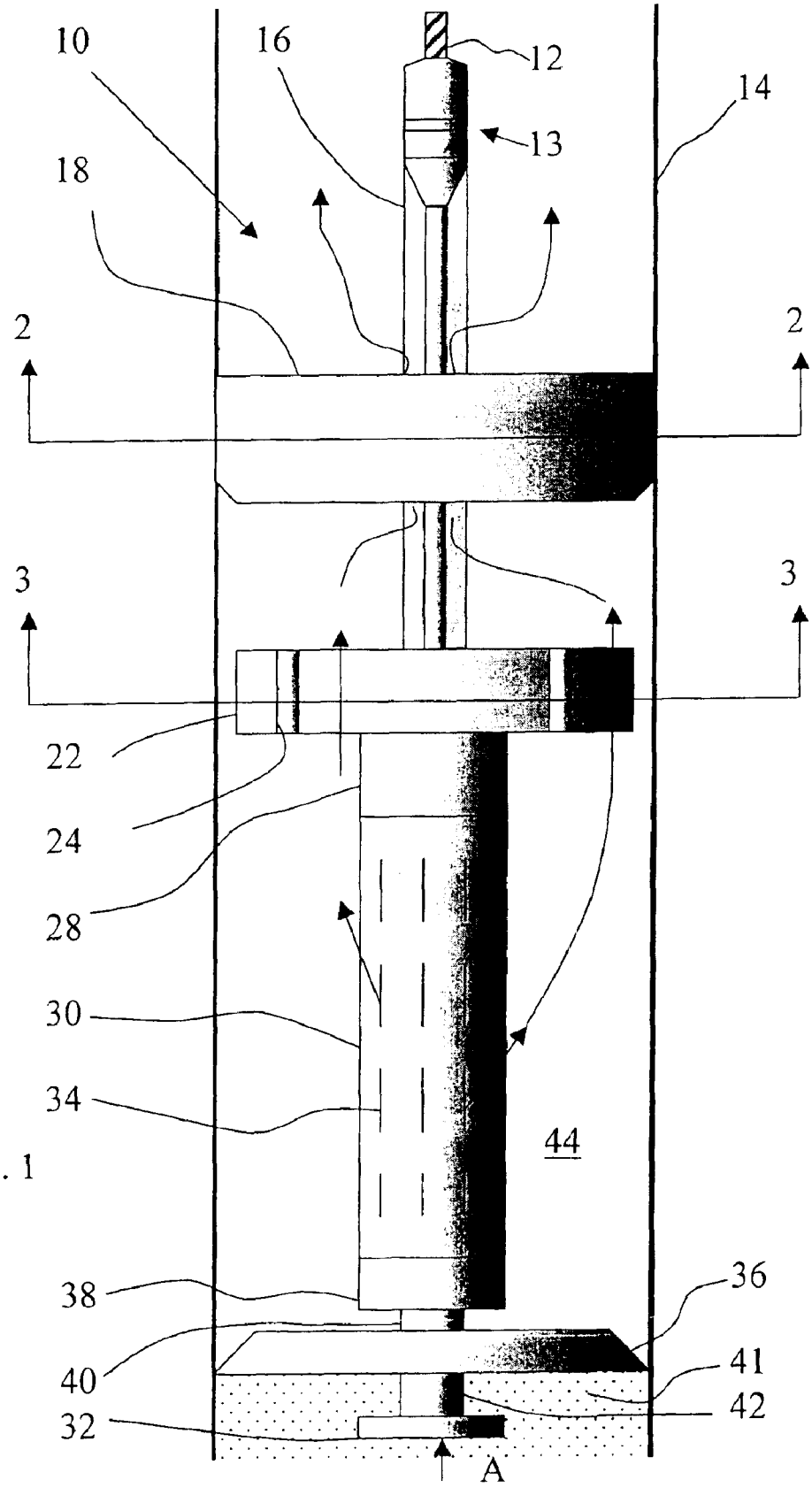
FIG. 1 shows a swabbing tool according to the invention in place in tubing installed in a wellbore.
Figure 2:
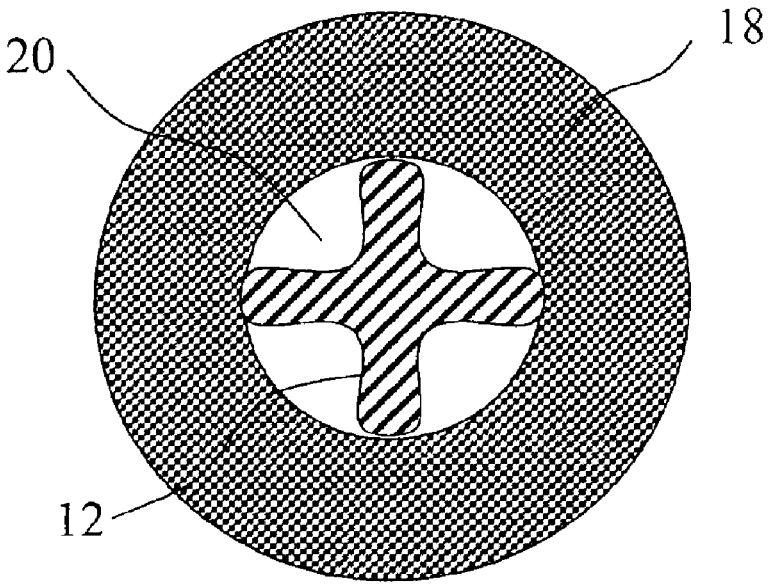
FIG. 2 is a section through a swab cup along the line 2—2 in FIG. 1.
Figure 3:
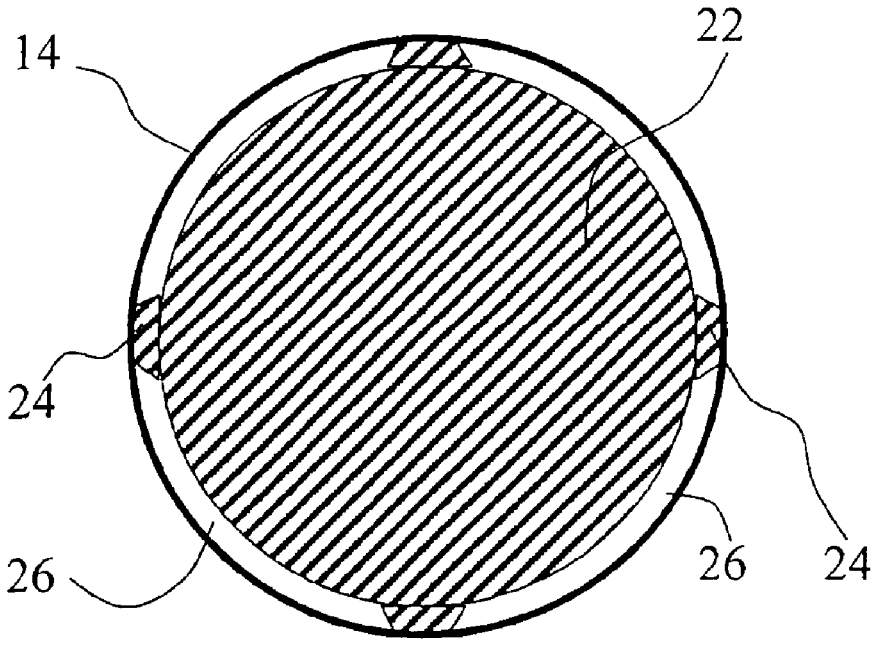
FIG. 3 is a section through a seal plate along the line 3—3 in FIG. 1.

Referring to FIG. 1, a conventional swabbing tool 10 is suspended from a connector 13, including a conventional socket, swivel, sinker bar and knuckle, terminating a wire line 12 within tubing 14 located in a well that penetrates a producing formation. The swabbing tool 10 includes a mandrel 16 and a number of swab cups 18 (only one is shown) attached to the lower end of the mandrel 16. The swab cups 18 are sized for the tubing or casing for which the swabbing tool 10 is intended. Passageways 20 (FIG. 2) between the swab cups 18 and the mandrel 16 allow fluid to bypass the swab cups 18 when the swabbing tool 10 is lowered into the well. The swab cups 18 are free to move up and down a limited amount along the mandrel 16 in conventional manner. Below the swab cups 18, a sealing plate 22 terminates the mandrel 16. The sealing plate 22 has several knobs 24 that create passageways 26 between the tubing 14 and sealing plate 22 for fluid to pass around the sealing plate 22. When the swabbing tool 10 is raised in the well, the weight of fluid on the swab cups 18 forces them down onto the sealing plate 22, which prevents fluid from entering the passageways 20. The swabbing tool 10 may then be lifted, creating suction in the tubing 14. The suction draws fluid from the underground producing formation penetrated by the well to enhance production.

In an embodiment of the present invention, a barrel adaptor 28 is installed on the lower end of the sealing plate 22 for example by threading or welding. The barrel adaptor 28 threads onto a hollow tubular sand sifter barrel 30 below the swab cups 18. By this arrangement, the sifter barrel 30 extends in an axial direction downhole of the mandrel 16. The sifter barrel 30 has an opening 32 at its lower end to allow fluid to enter the sifter barrel 30 from below as indicated by the arrow A. Openings such as slots 34 are machined, for example by laser cutting, into the wall of the sifter barrel 30 along the length of and around the sifter barrel 30. Due to the axial extension of the barrel 30, the slots 34 allow passage of fluid in a lateral direction, and due to the central location of the barrel 30, the slots 34 permit radial fluid flow through the slots 34. The openings typically are sized to filter sand from fluid passing through the slots 34. To prevent wellbore fluid from bypassing the sifter 30, an inverted swab cup 36 is attached to the lower end of the sifter barrel 30 and dimensioned to seal against the tubing 14. The swab cup 36 has an interior bore, not shown but may be the same as the swab cup 18 illustrated in FIG. 2, to allow passage of fluid into the barrel 30 from below the swab cup 36.

The barrel adaptor 28 may be a simple tubular connector that attaches to the lower end of the mandrel 16. In the case of a casing swabbing tool, the barrel adaptor 28 may be replaced by a fish neck mandrel (not shown) that threads at its uphole end to the mandrel 16, and on its downhole end to the sifter barrel 30 with conventional NPT threads. The swab cup 36 may be connected to the sifter barrel 24 using conventional fittings as shown such as an NPT coupler 38, a male to male nipple 40 and an NPT coupler 42, all of which are tubular with interior bores to allow passage of fluid through them. The swab cup 36 may be attached to the nipple 40. The dimensions of the parts are chosen according to the intended application, with larger parts used for casing.

The slots 34 in the barrel 30 may be 7.5 cm to 10 cm long, with a width in the order of 0.125 mm to 0.635 mm. If the slots 34 are laser cut, the width of the slots will vary due to expansion of the barrel 30 due to laser heat. Forty-eight slots have been found to be adequate in a barrel 96.5 cm long and 42.55 mm OD. The barrel may be made of light wall tubing.

In the operation of the swabbing tool 10, as the swabbing tool 10 is lowered into a well, the inverted swab cup 36 pushes down on fluid 41 that contains sand and other particles. The pressure from the swab cup 36 forces fluid and suspended particles through the inside of the sifter barrel 30. The slots 34 filter sand from the fluid and the remaining fluid passes into the annulus 44 above the inverted swab cup 36 and then through the passageways 20 between the mandrel 16 and swab cups 18 into the wellbore above the swabbing tool 10 as indicated by the arrows. Once enough fluid has enter the wellbore above the swabbing tool 10 and the swabbing tool 10 has reached the desired level in the wellbore, the swabbing tool 10 may be lifted in the wellbore in conventional manner. If the wellbore is completely filled with particles, the swab cup 36 will stop near the top of the fill, thus preventing the swabbing tool from becoming trapped in the particulates.

Using a sifter barrel 30 allows an arbitrarily large amount of open cross-sectional space in the sifter 30. The barrel 30 may be lengthened as required to create more slots 34. While it is possible to seal off the tubing with a filter that extends radially from the center of the wellbore into contact with the well tubing 14, such a design is difficult to build with enough open cross-sectional area to match the cross-sectional area of the passageways 20, particularly after the openings of the sifter have become partly clogged with sand or other debris or contaminants. Instead of an inverted swab cup 36, the barrel 30 could have an expanded width downhole with a sealing element on its outer periphery at its downhole extremity, but such a design is more complicated than providing an inverted swab cup. Any of the parts making up the downhole end of the sifter may be perforated.

Immaterial modifications may be made to the invention described here without departing from the essence of the invention.

What is claimed is:

1. A swabbing tool for wells, the swabbing tool comprising:

a mandrel;

at least one swab cup on the mandrel, the mandrel and swab cup being arranged to allow fluids to pass from below to above the swab cup;

a sifter attached to the swabbing tool below the swab cup for filtering particulates from fluid passing from below to above the swab cup; and a sealing element attached to the sifter to force fluid into the sifter.

2. The swabbing tool of claim 1 in which the sifter is barrel shaped.

3. The swabbing tool of claim 2 in which the sifter extends axially downhole from below the mandrel.

4. The swabbing tool of claim 3 in which the sifter comprises plural openings and the openings are oriented for lateral flow of fluid through the openings.

5. The swabbing tool of claim 3 in which the sifter if slotted to provide the sifter with a sifting function.

6. The swabbing tool of claim 1 in which the sifter has an interior and the sealing element is dimensioned to seal against a casing or tubing wall and force fluid into the sifter.

7. The swabbing tool of claim 1 in which the sifter has plural openings for sifting particulates from fluid passing through the sifter, and the openings in the sifter are slots.

8. The swabbing tool of claim 7 in which the openings have a size between 0.125 mm and 0.635 mm.

9. The swabbing tool of claim 7 in which the sifter has plural openings for sifting particulates from fluid flowing through the sifter, the openings being oriented to permit lateral flow of fluid through the openings.

* * * * *